US006571813B2

(12) United States Patent
Lin et al.

(10) Patent No.: US 6,571,813 B2
(45) Date of Patent: Jun. 3, 2003

(54) UPWARDLY AND DOWNWARDLY ACTUATED SAFETY RUNNER FOR FOLDABLE UMBRELLA

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 0 days.

(21) Appl. No.: 09/911,449

(22) Filed: Jul. 25, 2001

(65) Prior Publication Data

US 2003/0019513 A1 Jan. 30, 2003

(51) Int. Cl.[7] ..... A45B 25/06
(52) U.S. Cl. ..... 135/28; 135/41
(58) Field of Search ..... 135/28, 37, 38, 135/39

(56) References Cited

U.S. PATENT DOCUMENTS 3,856,032 A * 12/1974 Schafer ..... 135/28
5,494,064 A * 2/1996 Chuang Lee ..... 135/28
5,588,455 A * 12/1996 Kuo ..... 135/28
5,615,698 A * 4/1997 Ko ..... 135/28
5,911,233 A * 6/1999 Wu ..... 135/28
6,006,771 A * 12/1999 Wu ..... 135/28
6,371,141 B1 * 4/2002 Lin et al. ..... 135/28

FOREIGN PATENT DOCUMENTS

GB 2321007 * 7/1998

* cited by examiner

*Primary Examiner*—Janet M. Wilkens
(74) *Attorney, Agent, or Firm*—Troxell Law Office PLLC

(57) ABSTRACT

A safety runner of a foldable umbrella includes a runner body slidably held on a central shaft of the umbrella, and an actuating sleeve slidably coupled with the runner body having a thrusting protrusion formed on the actuating sleeve for engaging a sloping portion formed on a spring catch, which is resiliently held on the central shaft for locking the runner when opening the umbrella; whereby upon a downward movement of the runner by cooperatively pulling the actuating sleeve downwardly, the thrusting protrusion on the actuating sleeve will thrust the sloping portion of the spring catch inwardly to disengage the spring catch from the runner, thereby allowing a smooth operation for closing the umbrella.

2 Claims, 6 Drawing Sheets

UPWARDLY AND DOWNWARDLY ACTUATED SAFETY RUNNER FOR FOLDABLE UMBRELLA

BACKGROUND OF THE INVENTION

A conventional safety runner R as shown in FIG. 9 is slidably held on a central shaft of an umbrella and is locked when opening the umbrella by a catch C resiliently held in the central shaft. For closing and folding the umbrella, a tab (or push button) T is depressed inwardly (transversely or horizontally) to disengage the catch C from the runner R, thereby allowing a downward movement of the runner R for retracting the ribs and closing the umbrella.

However, when raising the runner R to extend the ribs in order to open the umbrella, the tab T may be always depressed by a user's fingers to retard the resilient protruding of the catch C from the central shaft, thereby influencing the engagement of the catch C with the runner R and affecting the smooth operation for opening the umbrella.

The present inventor has found the drawbacks of the conventional safety runner and invented the present safety runner for an ergonomic operation when opening and closing the umbrella.

SUMMARY OF THE INVENTION

The object of the present invention is to provide a safety runner of a foldable umbrella includes a runner body slidably held on a central shaft of the umbrella, and an actuating sleeve slidably coupled with the runner body having a thrusting protrusion formed on the actuating sleeve for engaging a sloping portion formed on a spring catch, which is resiliently held on the central shaft for locking the runner when opening the umbrella; whereby upon a downward movement of the runner by cooperatively pulling the actuating sleeve downwardly, the thrusting protrusion on the actuating sleeve will thrust the sloping portion of the spring catch inwardly to disengage the spring catch from the runner, thereby allowing a smooth operation for closing the umbrella; and upon an upward movement of the actuating sleeve and the runner body, the spring catch will be smoothly resiliently protruded for locking the runner for opening the umbrella without being retarded by any part of the runner.

DETAILED DESCRIPTION

Figure 1:
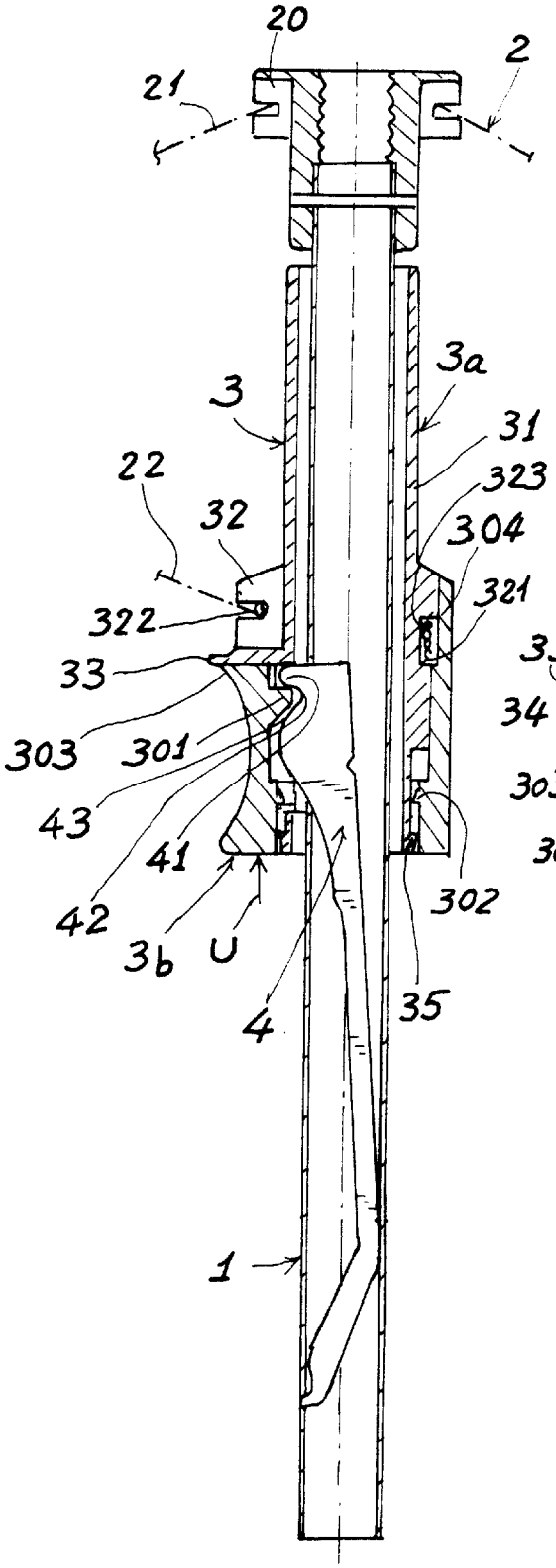
FIG. 1 is a sectional drawing of the present invention when opening the umbrella.
Figure 2:
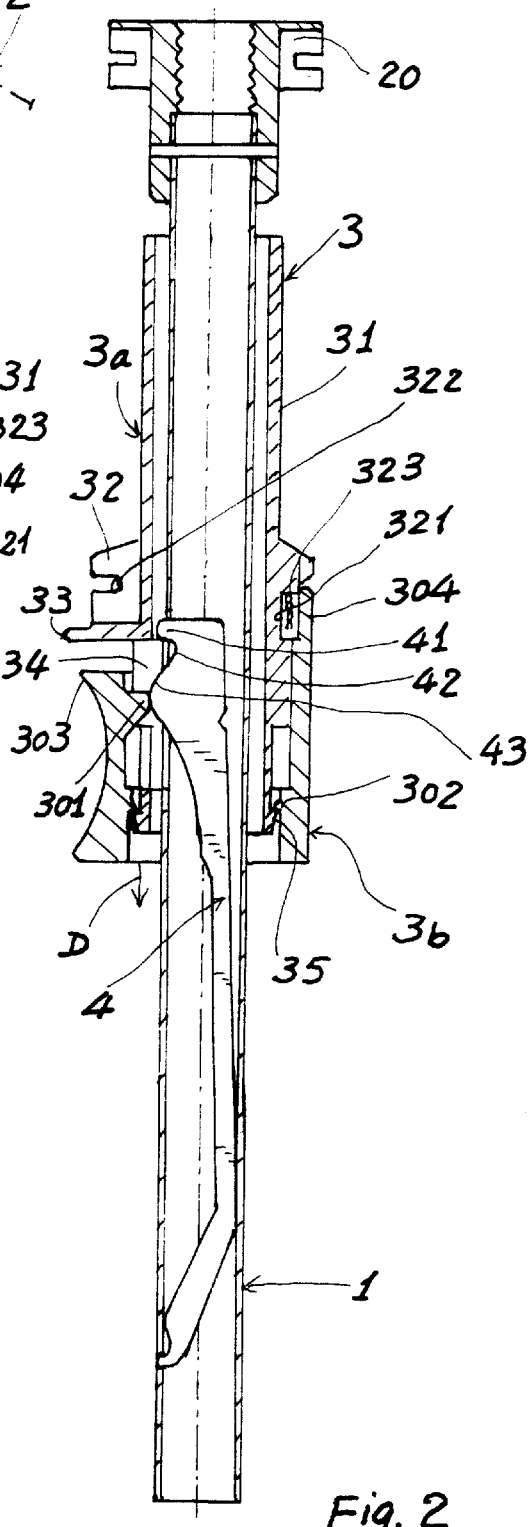
FIG. 2 is a sectional drawing of the present invention when closing the umbrella.
Figure 3:
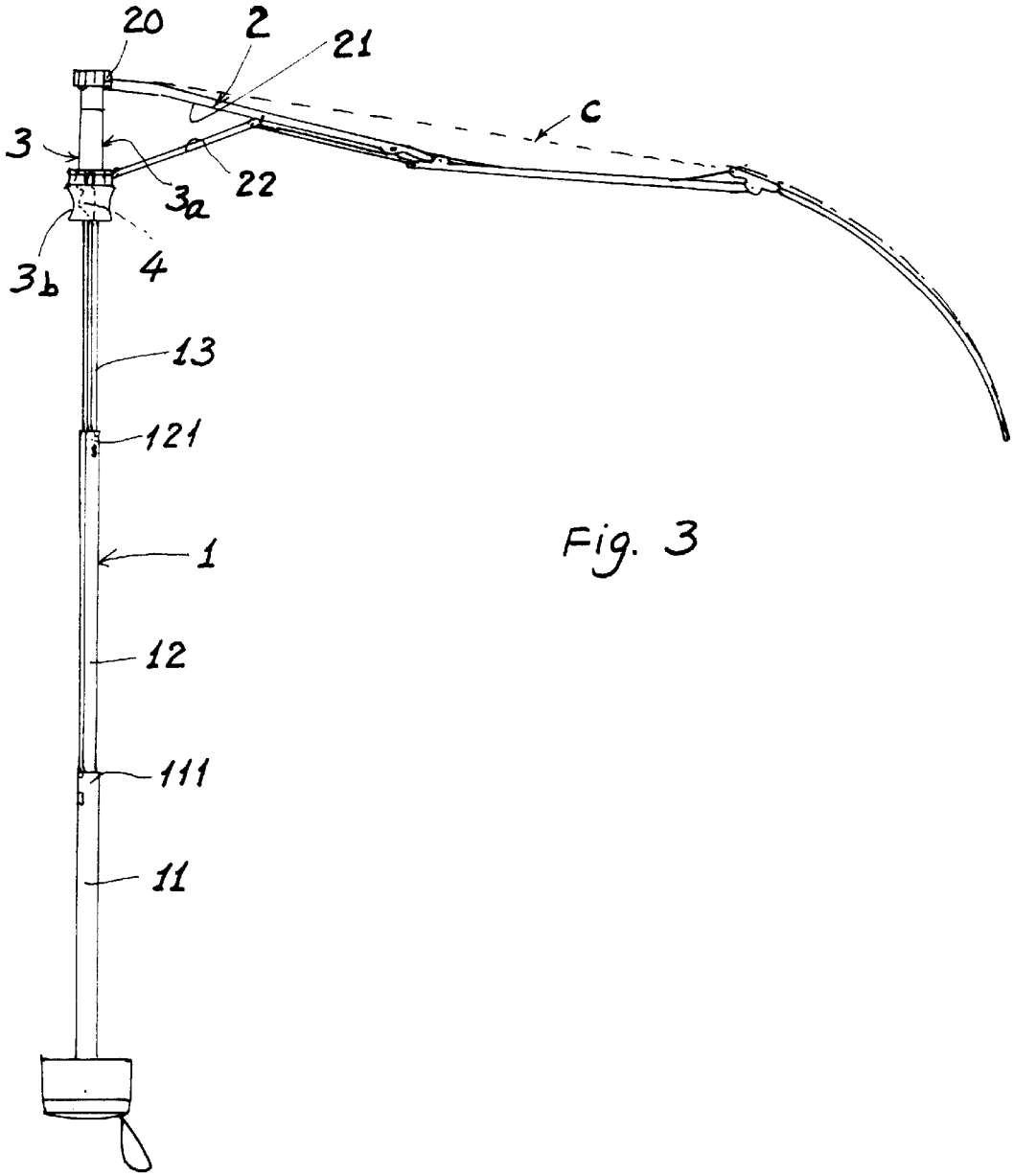
FIG. 3 is an illustration showing an opening umbrella of the present invention.

As shown in FIGS. 1~3, the present invention comprises: a central shaft 1 consisting of a plurality of tubes including a lower tube 11, a middle tube 12 and an upper tube 13 telescopically engageable with one another; a rib assembly 2 having at least a top rib 21 pivotally secured to an upper notch 20 formed on a top of the central shaft 1 and a stretcher rib 22 pivotally connected between said top rib 21 and a runner or a lower runner 3 slidably held on the central shaft 1; and a spring catch (or an upper spring catch) 4 resiliently formed on (or in) the central shaft 1 for locking the runner 3 when opening the umbrella as shown in FIGS. 1 and 3.

The detailed structures or modifications of the central shaft 1 and the rib assembly 2 are not limited in the present invention.

The safety runner of the present invention may be used in a foldable umbrella including single fold and multiple folds.

The runner 3 includes: a runner body 3*a* slidably held on the central shaft 1 and pivotally connected with the stretcher rib 22 of the rib assembly 2, with the runner body 3*a* locked by the spring catch 4 when opening the umbrella; and an actuating sleeve 3*b* slidably coupled with the runner body 3*a* and operatively retracting the spring catch 4 to disengage the runner 3 from the spring catch 4 for closing the umbrella when downwardly pulling the runner 3.

The runner body 3*a* includes: a tubular member 31 slidably held on the central shaft 1, a ferrule portion 32 annularly formed on a middle portion of the tubular member 31 for pivotally connecting the stretcher rib 22 of the rib assembly 2, a shoulder portion 33 formed in the tubular member 31 below the ferrule portion 32 for limiting the actuating sleeve 3*b* when upwardly raised, a slot 34 formed in the tubular member 31 for protruding the spring catch 4 outwardly for engaging the spring catch 4 with an upper slot wall of the slot 34 or with the shoulder portion 33 for locking the runner 3 for opening the umbrella (FIG. 1), and a bottom extension ring 35 annularly formed on a bottom periphery of the tubular member 31 for limiting a downward movement of the actuating sleeve 3*b* (FIG. 2).

The actuating sleeve 3*b* includes: a central hole 300 for slidably engaging the tubular member 31 of the runner body 3*a*; a thrusting protrusion 301 formed on an inside wall of the central hole 300 of the actuating sleeve 3*b* for engaging a recess 42 as recessed in the spring catch 4 and having a sloping surface formed on a lower portion of the thrusting protrusion 301 for engaging a sloping portion 43 formed on the spring catch 4 adjacent to the recess 42; a ratchet ring 302 annularly formed on a lower portion of the actuating sleeve 3*b* for engaging and limiting the bottom extension ring 35 of the runner body 3*a* when downwardly pulling the actuating sleeve 3*b*; an upper rim 303 arcuately formed on an upper perimeter of the actuating sleeve 3*b* to be limited by the shoulder portion 33 of the runner body 3*a* when raising the actuating sleeve 3*b* for opening the umbrella; and a cover portion 304 protruding upwardly from the actuating sleeve 3*b* for covering a wire slot 321 which is recessed in the ferrule portion 32 of the runner body 3*a* for storing a wire knot 323 by tying two wire ends of a fastening wire 322 secured on the ferrule portion 32 for pivotally securing the stretcher rib 22 of the rib assembly 2 on the ferrule portion 32.

The cover portion 304 on the sleeve 3*b* will prevent the wire knot 323 from sticking or injuring the umbrella user.

The spring catch 4 as resiliently fixed in the central shaft 1 includes: a latch portion 41 formed on a top portion of the spring catch 4 for engaging the upper slot end of the slot 34 formed in the runner body 3*a* of the runner 3 (or for engaging the shoulder portion 33 of the runner body 3*a*); the recess 42 recessed in the spring catch 4 adjacent the latch portion 41 to be engageable with the thrusting protrusion 301 of the actuating sleeve 3*b*; and the sloping portion 43 sloping downwardly outwardly from the recess 42 to be tangential to and engageable with the sloping surface formed on the lower portion of the thrusting protrusion 301; whereby upon lowering (D) of the actuating sleeve 3*b*, the thrusting protrusion 301 of the actuating sleeve 3*b* will thrust the sloping portion 43 of the spring catch 4 to retract the catch 4 inwardly for disengaging the catch 4 from the runner 3 for closing the umbrella (from FIG. 1 to FIG. 2).

For opening the umbrella of the present invention, the actuating sleeve 3*b* and the runner 3 are raised upwardly (U) to allow the latch portion 41 of the spring catch 4 to engage the upper slot wall of the slot 34 (or the shoulder portion 33) of the runner body and to engage the thrusting protrusion 301 of the actuating sleeve 3*b* with the recess 42 in the catch 4, thereby locking the runner 3 on the catch 4 for stably opening the umbrella (FIGS. 1, 3).

For closing the umbrella, the actuating sleeve 3*b* is pulled downwardly (D) to allow the thrusting protrusion 301 to thrust and retract the sloping portion 43 of the catch 4 to disengage the catch 4 from the runner 3; and upon engagement of the ratchet ring 302 with the bottom extension 35 of the runner body 3*a*, the actuating sleeve 3*b* will be coupled with the runner body 3*a* to be simultaneously pulled downwardly to unlock the runner 3 from the catch 4 for closing the umbrella (FIG. 2).

The safety runner of the present invention is superior to the conventional safety runner with the following advantages:

1. For closing the umbrella, the actuating sleeve 3*b* is pulled downwardly (not a transverse or horizontal push-button operation) to directly instantly unlock the runner 3 from the catch 4 for an ergonomic operation for closing the umbrella.
2. For opening the umbrella, the actuating sleeve 3*b* and the runner body 3*a* are raised upwardly to allow a resilient protruding of the spring catch 4 for locking the runner 3 without retarding the outward protruding of the catch 4, thereby providing a smooth reliable operation for opening the umbrella.

Figure 4:
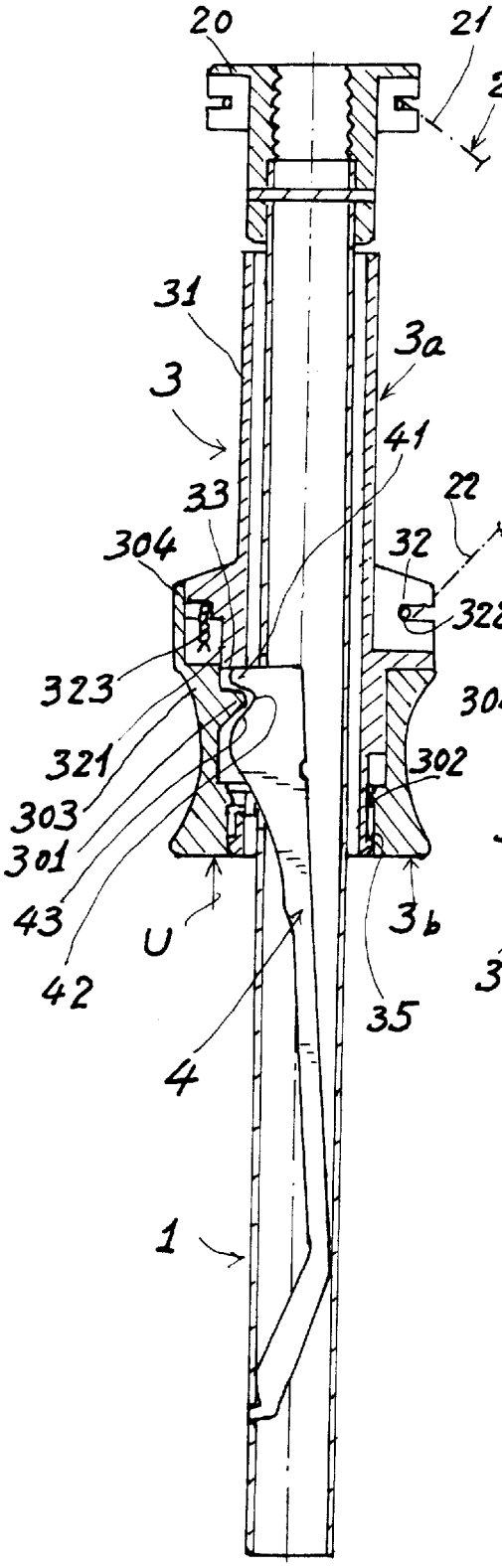
FIG. 4 is a sectional drawing of another preferred embodiment of the present invention when opening the umbrella.
Figure 5:
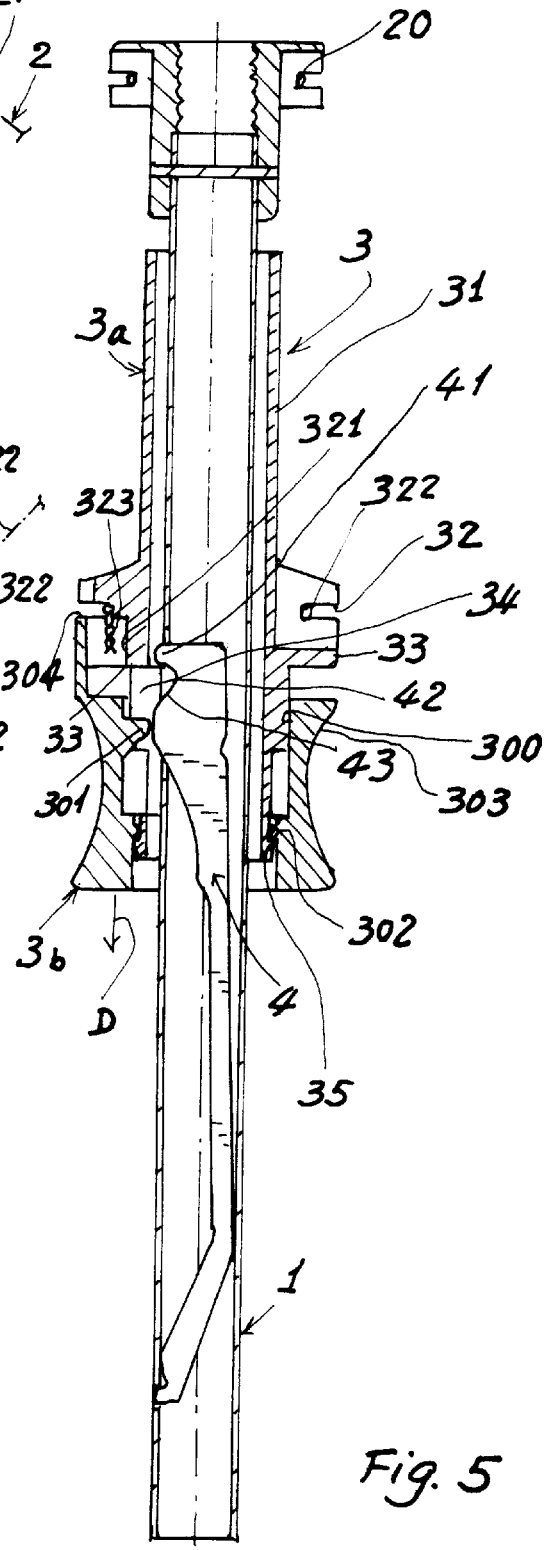
FIG. 5 is a sectional drawing of the present invention when closed from FIG. 4.
Figure 6:
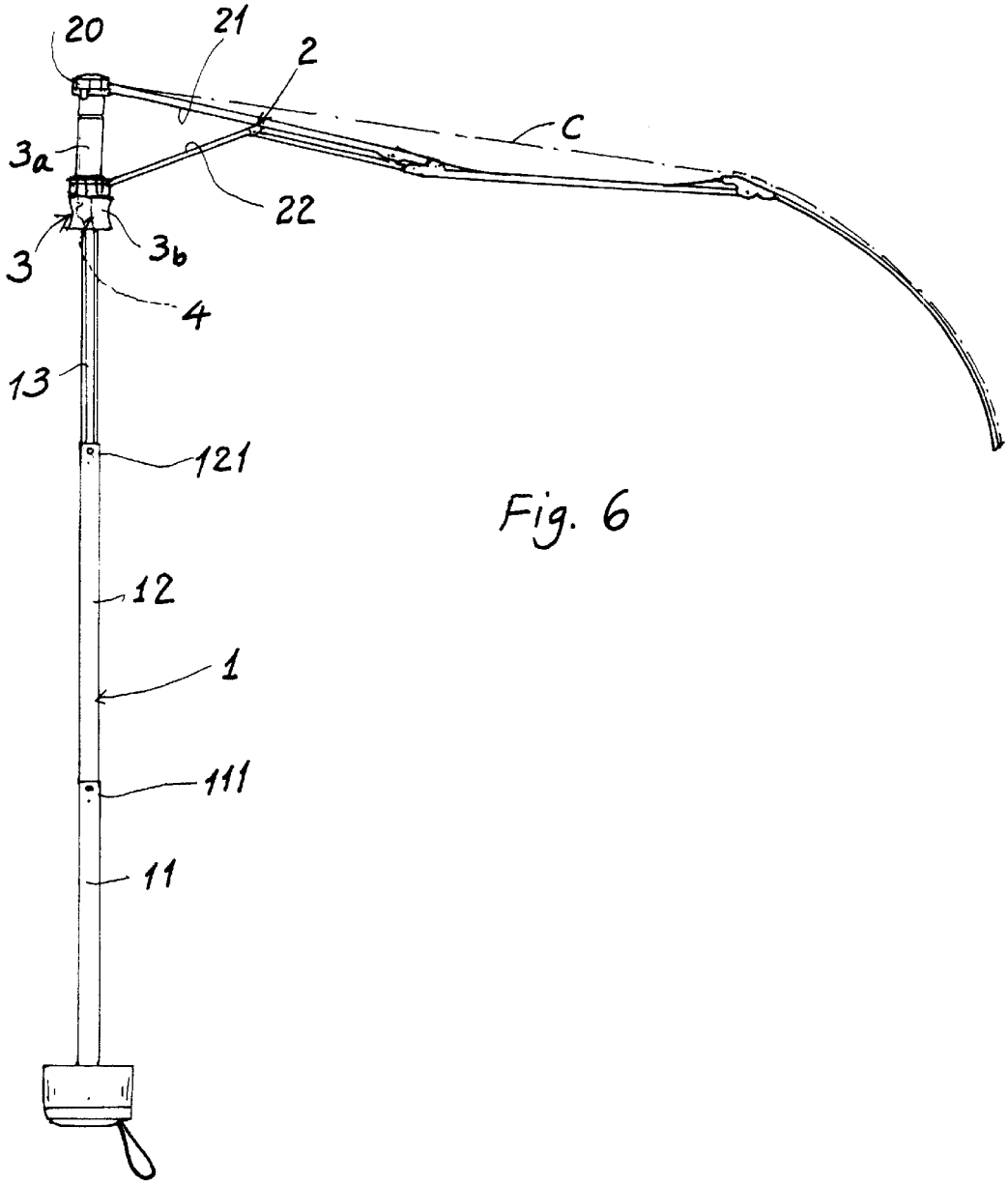
FIG. 6 is an illustration of an opening umbrella of FIG. 4.

The structure of the present invention as shown in FIGS. 1~3 is suitable for a foldable umbrella having its umbrella cloth C secured on six sets of rib assembly 2. For the structure as shown in FIGS. 4~6 it may be adapted for securing the umbrella cloth C on eight sets of rib assembly 2.

The cover portion 304 (FIGS. 4~6) is directly protruded upwardly from the upper rim 303 of the actuating sleeve 3*b* adjacent to the thrusting protrusion 301 of the sleeve 3*b*. Other modifications may be made in accordance with the present invention.

The cross sections of the tubes 11, 12, 13 of the central shaft 1 may be different and diversified, not limited in the present invention.

Figure 7:
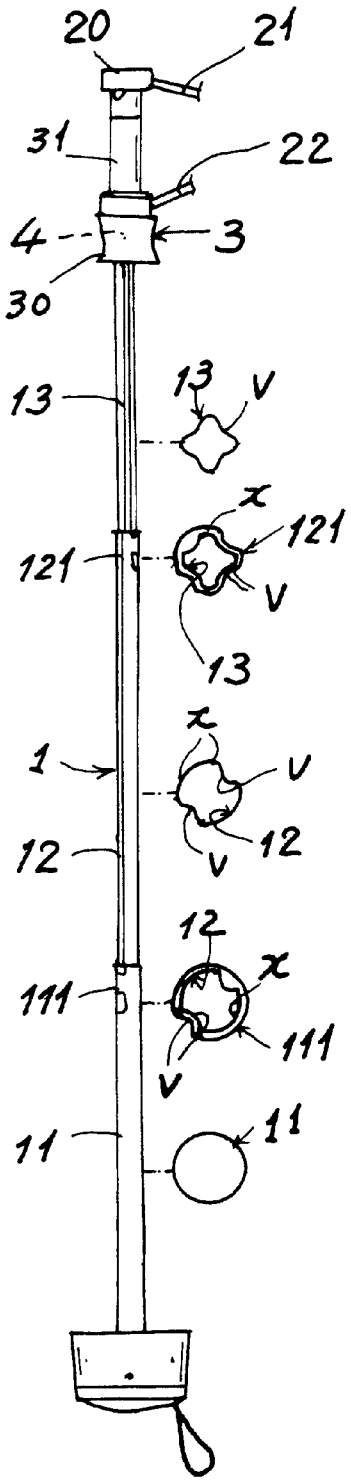
FIG. 7 shows the tubes of a central shaft of the umbrella of FIG. 3.

As shown in FIG. 7 (corresponding to FIG. 3), the lower tube 11 of the shaft 1 has a cross section of circular shape; the middle tube 12 having a cross section consisting of two concave quadrants V and two convex quadrants X; and the upper tube 13 having a cross section consisting of four concave quadrants V. The upper portion 111 of the lower tube 11 has a cross section having a concave quadrant V as recessed from the circular perimeter. The upper portion 121 of the middle tube 12 has a cross section consisting of three concave quadrants V and one convex quadrant X.

Figure 8:
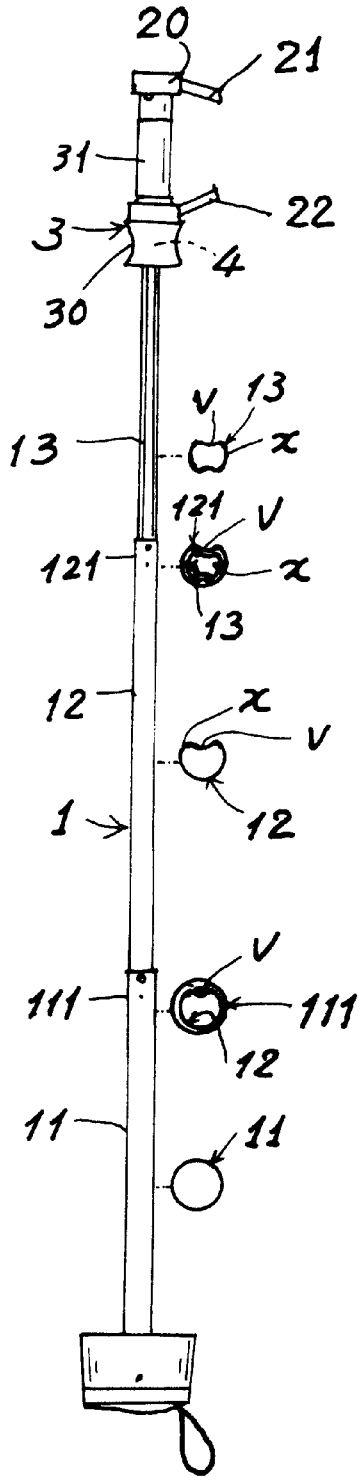
FIG. 8 shows the tubes of a central shaft of the umbrella of FIG. 6.
Figure 9:
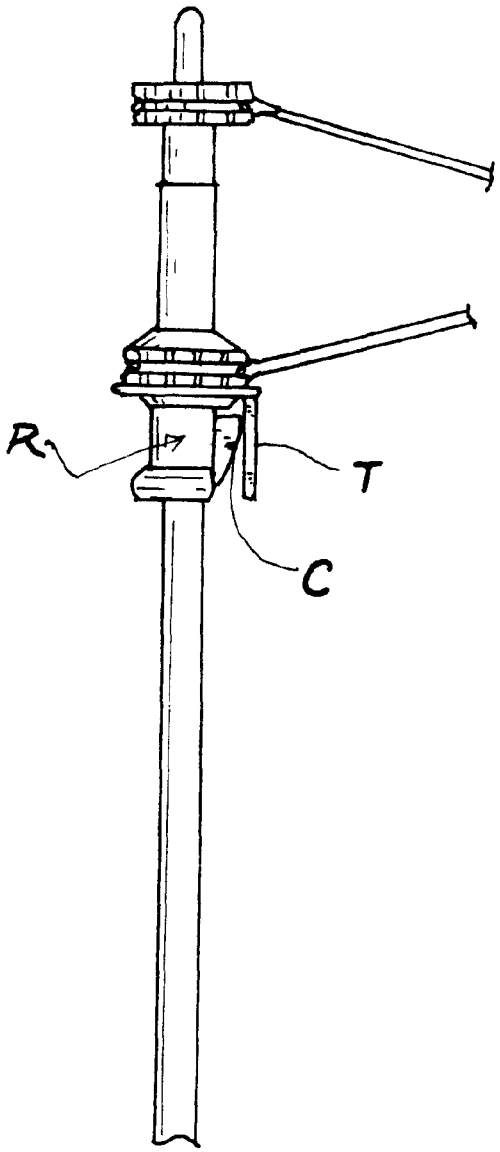
PRIOR ART Fig. 9
FIG. 9 shows a prior art of a conventional safety runner.

As shown in FIG. 8 (corresponding to FIG. 6), the lower tube 11 has a cross section of circular shape; a middle tube 12 having a cross section having a concave quadrant V as recessed from a circular perimeter; and the upper tube 13 having a cross section consisting of two concave quadrants V and two convex quadrants X. The upper portion 111 of the lower tube 11 has a cross section having a concave quadrant V as recessed from a circular perimeter. The upper portion 121 of the middle tube 12 has a cross section consisting of two concave quadrants V and two convex quadrants X.

We claim:

1. A safety runner for a foldable umbrella, which includes a central shaft; a rib assembly having at least a top rib pivotally secured to a top of the central shaft and a stretcher rib pivotally connected between the top rib and a runner slidably held on the central shaft, with said runner operatively locked by a spring catch resiliently fixed in the central shaft when opening the umbrella;

said runner including: a runner body slidably held on the central shaft and pivotally connected with said stretcher rib of the rib assembly, with the runner body locked by the spring catch when opening the umbrella; and an actuating sleeve slidably coupled with the runner body and operatively retracting the spring catch to disengage the runner body from the spring catch for closing the umbrella when downwardly pulling said actuating sleeve and said runner body;

said runner body including: a tubular member slidably held on the central shaft, a ferrule portion annularly formed on a middle portion of the tubular member for pivotally connecting the stretcher rib of the rib assembly, a shoulder portion formed in the tubular member below the ferrule portion for limiting the actuating sleeve when upwardly raised, a slot formed in the tubular member for protruding the spring catch outwardly for engaging the spring catch with an upper slot wall of the slot for locking the runner when opening the umbrella, and a bottom extension ring annularly formed on a bottom periphery of the tubular member for limiting a downward movement of the actuating sleeve; and said actuating sleeve including: a central hole for slidably engaging the tubular member of the runner body; a thrusting protrusion formed on an inside wall of the central hole of the actuating sleeve for engaging a recess as recessed in the spring catch and having a sloping surface formed on a lower portion of the thrusting protrusion for engaging a sloping portion formed on the spring catch adjacent to the recess; a ratchet ring annularly formed on a lower portion of the actuating sleeve for engaging and limiting the bottom extension ring of the runner body when downwardly pulling the actuating sleeve; an upper rim arcuately formed on an upper perimeter of the actuating sleeve to be limited by the shoulder portion of the runner body when raising the actuating sleeve when opening the umbrella; and a cover portion protruding upwardly from the actuating sleeve for covering a wire slot which is recessed in the ferrule portion of the runner body for storing a wire knot by tying two wire ends of a fastening wire secured on the ferrule portion for pivotally securing the stretcher rib of the rib assembly on the ferrule portion.

2. A safety runner according to claim 1, wherein said spring catch as resiliently fixed in the central shaft includes: a latch portion formed on a top portion of the spring catch for engaging the upper slot end of the slot formed in the runner body of the runner; the recess recessed in the spring catch adjacent the latch portion to be engageable with the thrusting protrusion of the actuating sleeve; and the sloping portion sloping downwardly outwardly from the recess to be tangential to and engageable with the sloping surface formed on the lower portion of the thrusting protrusion; whereby upon lowering of the actuating sleeve, the thrusting protrusion of the actuating sleeve will thrust the sloping portion of the spring catch to retract the catch inwardly for disengaging the catch from the runner for closing the umbrella.

* * * * *